US010947976B2

(12) United States Patent
Yano et al.

(10) Patent No.: US 10,947,976 B2
(45) Date of Patent: Mar. 16, 2021

(54) SCREW COMPRESSOR

(71) Applicant: Kobe Steel, Ltd., Hyogo (JP)

(72) Inventors: Yoshio Yano, Kobe (JP); Toshiyuki Miyatake, Hyogo (JP); Masahiro Kikuchi, Kobe (JP)

(73) Assignee: Kobe Steel, Ltd., Hyogo (JP)

( * ) Notice: Subject to any disclaimer, the term of this patent is extended or adjusted under 35 U.S.C. 154(b) by 285 days.

(21) Appl. No.: 16/060,065

(22) PCT Filed: Nov. 15, 2016

(86) PCT No.: PCT/JP2016/083831
§ 371 (c)(1),
(2) Date: Jun. 7, 2018

(87) PCT Pub. No.: WO2017/104334
PCT Pub. Date: Jun. 22, 2017

(65) Prior Publication Data

US 2018/0355867 A1 Dec. 13, 2018

(30) Foreign Application Priority Data

Dec. 17, 2015 (JP) ..... JP2015-246281

(51) Int. Cl.
*F04C 29/00* (2006.01)
*F04C 18/16* (2006.01)
*F04C 23/00* (2006.01)

(52) U.S. Cl.
CPC ..... *F04C 29/005* (2013.01); *F04C 18/16* (2013.01); *F04C 29/0085* (2013.01);
(Continued)

(58) Field of Classification Search
CPC ..... F04C 18/16–18; F04C 23/001–003; F04C 23/02; F04C 29/005; F04C 29/0085;
(Continued)

(56) References Cited

U.S. PATENT DOCUMENTS 2,669,881 A * 2/1954 Skidmore ..... F16H 1/20 74/421 R
3,407,996 A * 10/1968 Olofsson ..... F04C 29/005 418/9

(Continued)

FOREIGN PATENT DOCUMENTS

CN 1892034 A 1/2007
CN 101581304 A 11/2009

(Continued)

OTHER PUBLICATIONS

International Preliminary Report on Patentability issued in corresponding International Application No. PCT/JP2016/083831; dated Jun. 28, 2018.

(Continued)

*Primary Examiner* — Alexander B Comley
(74) *Attorney, Agent, or Firm* — Studebaker & Brackett PC

(57) ABSTRACT

The screw compressor includes a first-stage compressor main body and a second-stage compressor main body for compressing fluid with screw rotors, a motor for driving the first-stage compressor main body and the second-stage compressor main body, and a gear box. The gear box is connected to the first-stage compressor main body, the second-stage compressor main body, and the motor; transmits a driving force of the motor to the screw rotors, and includes a first attachment hole for attaching the first-stage compressor main body and a second attachment hole for attaching the second-stage compressor main body; and is provided with an annular rib surrounding both of the first attachment hole and the second attachment hole. In the screw compressor, the vibration of the natural vibration mode which is most burdensome and should be reduced can be efficiently reduced.

11 Claims, 4 Drawing Sheets

(52) U.S. Cl.
CPC .... *F04C 23/001* (2013.01); *F04C 2210/1005* (2013.01); *F04C 2270/12* (2013.01)

(58) Field of Classification Search
CPC ..... F04C 2210/1005; F04C 2270/12; F04C 2270/125; F01C 21/007–008
USPC ..... 418/9, 10, 197, 205
See application file for complete search history.

(56) References Cited

U.S. PATENT DOCUMENTS

| | | | | | |
|---|---|---|---|---|---|
| 4,174,196 | A * | 11/1979 | Mori | F04C 29/04 | 418/9 |
| 4,524,638 | A * | 6/1985 | Van Hee | F04B 35/00 | 403/4 |
| 6,073,517 | A * | 6/2000 | Pauwels | F04C 29/06 | 74/606 R |
| 6,991,440 | B2 * | 1/2006 | Achtelik | F04C 18/16 | 418/201.1 |
| 8,205,469 | B2 | 6/2012 | Tsuboi | | |
| 8,342,829 | B2 * | 1/2013 | Achtelik | F04C 18/16 | 418/201.1 |
| 2004/0146414 | A1 * | 7/2004 | Nichol | F04C 29/0021 | 417/410.4 |
| 2009/0277215 | A1 * | 11/2009 | Tsuboi | F04C 18/16 | 62/498 |
| 2012/0257997 | A1 * | 10/2012 | Morita | F04C 27/009 | 417/415 |
| 2015/0047383 | A1 | 2/2015 | Hong et al. | | |

FOREIGN PATENT DOCUMENTS

| | | | | |
|---|---|---|---|---|
| CN | 201874822 | U | | 6/2011 |
| JP | S53-53009 | A | | 5/1978 |
| JP | S5353009 | | * | 5/1978 |
| JP | H10-318159 | A | | 12/1998 |
| KR | 10-2013-0106737 | A | | 9/2013 |
| WO | 00/53931 | A1 | | 9/2000 |

OTHER PUBLICATIONS

International Search Report issued in PCT/JP2016/083831; dated Feb. 14, 2017.

* cited by examiner

SCREW COMPRESSOR

CROSS-REFERENCE TO RELATED APPLICATIONS

This is a national phase application in the United States of International Patent Application No. PCT/JP2016/083831 with an international filing date of Nov. 15, 2016, which claims priority of Japanese Patent Application No. 2015-246281 filed on Dec. 17, 2015 the contents of which are incorporated herein by reference.

TECHNICAL FIELD

The present invention relates to a screw compressor.

BACKGROUND ART

Screw compressors are widely used as supply sources of high pressure air in factories and the like. The screw compressor includes a motor, a gear box, and a compressor main body. Power from the motor is transmitted to the compressor main body via gears in the gear box. The transmitted power rotates screw rotors in the compressor main body to compress fluid such as air. At this time, the screw rotors rotate at high speed with both ends supported by bearings. Therefore, bearings are required to be designed to be resistant to breakage, and it is preferable that the vibration of the bearing portion is as small as possible.

In addition, the compressor main body and the gear box have a plurality of natural frequencies. When the natural frequency and the rotational speed of the compressor main body coincide, a resonance phenomenon occurs, and the vibration of the bearing portion of the compressor main body increases. In order to prevent the increase in vibration, it is preferable to set the natural frequency to be outside the rotational speed range of the compressor main body. However, it is practically impossible to avoid all of the plurality of natural frequencies from the rotational speed range of the compressor main body. Therefore, as for the natural frequency which cannot be avoided, it is preferable to perform design so that the vibration during resonance is made as small as possible.

For example, JP H10-318159 A discloses a compressor for reducing the vibration to be transmitted by a gear box with the structure of the gear box (coupling piece).

SUMMARY OT THE INVENTION

Problems to be Solved by the Invention

In the compressor described in JP H10-318159 A, the natural vibration mode is not studied in detail, and efficient vibration reduction is not achieved.

An object of the present invention is to efficiently reduce the vibration of a screw compressor.

Means for Solving the Problems

As a result of various experiments and analyses on the vibration of a screw compressor, the inventor of the present invention specified a natural vibration mode in which the vibration is conspicuous among a plurality of natural vibration modes (hereinafter referred to as a "specific natural vibration mode"). Specifically, the specific natural vibration mode is a vibration mode in the horizontal direction in which the first stage compressor main body and the second stage compressor main body repeat approaching and separating. The present invention is based on this new knowledge.

The present invention provides a screw compressor comprising: a first-stage compressor main body and a second-stage compressor main body respectively configured to compress fluid with screw rotors; an electric motor configured to drive the first-stage compressor main body and the second-stage compressor main body; and a gear box connected to the first-stage compressor main body, the second-stage compressor main body, and the electric motor, configured to transmit a driving force of the electric motor to the screw rotors, including a first attachment hole for attaching the first-stage compressor main body and a second attachment hole for attaching the second-stage compressor main body, provided with an annular rib surrounding both of the first attachment hole and the second attachment hole.

According to the above configuration, the vibration in the specific natural vibration mode can be efficiently reduced. Specifically, providing an annular rib around a first attachment hole and a second attachment hole of the gear box to improve the rigidity against the specific natural vibration mode allows the screw compressor to be reduced in vibration and to be made resistant to breakage.

The annular rib includes: a first rib region being a portion provided around the first attachment hole, a second rib region being a portion provided around the second attachment hole, and a third rib region being a region between the first rib region and the second rib region, wherein a maximum space in a vertical direction between an upper portion and a lower portion of a first rib portion constituting the first rib region is a first space, wherein a maximum space in a vertical direction between an upper portion and a lower portion of a second rib portion constituting the second rib region is a second space, wherein a maximum space in a vertical direction between an upper portion and a lower portion of a third rib portion constituting the third rib region is a third space. Preferably, the third space is not more than the first space and not more than the second space, a central upper rib being a rib on an upper side of the third rib portion is arranged above an imaginary center line connecting a center of the first attachment hole and a center of the second attachment hole, and a central lower rib being a rib on a lower side of the third rib portion is arranged below the imaginary center line.

Since the third space is not more than the first space and not more than the second space, the rigidity against the specific natural vibration mode of the third rib portion can be improved and the vibration of the specific natural vibration mode can be suppressed. This is because a comparison of when the third space is wide and when the third space is narrow shows that the rigidity against the specific natural vibration mode improves when the third space is narrow. In addition, since the central upper rib is arranged above the imaginary center line and the central lower rib is arranged below the imaginary center line, the rib arrangement in the vertical direction can be balanced, and the torsion on the attachment surfaces of the first-stage compressor main body and the second-stage compressor main body of the gear box can be suppressed. It should be noted that the center of the attachment hole means the position of the center of gravity of a mass body when the mass body having a uniform density is filled in the attachment hole.

Preferably, a plate thickness of the gear box between the central upper rib and the central lower rib is larger than an average value of plate thicknesses of other portions of the gear box.

Since the portion of the gear box between the central upper rib and the central lower rib has an amount of deformation larger than other portions of the gear box in the vibration of the specific natural vibration mode, increasing the plate thickness of this portion allows the rigidity against the specific natural vibration mode to be improved and the vibration of the specific natural vibration mode to be suppressed.

Preferably, the screw compressor further comprises a fourth rib portion connecting a connection portion between the first rib portion and the central upper rib and a connection portion between the first rib portion and the central lower rib, and a fifth rib portion connecting a connection portion between the second rib portion and the central upper rib and a connection portion between the second rib portion and the central lower rib.

Providing the fourth rib portion and the fifth rib portion causes the rigidity around the first attachment hole and the second attachment hole to be improved and the rigidity against the specific natural vibration mode to be improved, and allows the rigidity against the torsion on the attachment surfaces of the first-stage compressor main body and the second-stage compressor main body to be also improved. Therefore, both vibration of the specific natural vibration mode and torsion can be suppressed.

Preferably the screw compressor further comprises a sixth rib portion connecting an outer periphery of the first attachment hole and the first rib portion or the fourth rib portion. Further, it is preferable that the screw compressor comprises a seventh rib portion connecting an outer periphery of the second attachment hole and the second rib portion or the fifth rib portion.

Providing the sixth rib portion and the seventh rib portion allows the rigidity around the first attachment hole and the second attachment hole and the rigidity against the torsion on the attachment surfaces of the first-stage compressor main body and the second-stage compressor main body to be improved. Therefore, both vibration of the specific natural vibration mode and torsion can be suppressed.

Preferably, the screw compressor further comprises, between the central upper rib and the central lower rib, an eighth rib portion extending along the central upper rib or the central lower rib, or extending along the central lower rib within a range of an angle formed between the central upper rib and the central lower rib.

Providing the eighth rib portion allows the rigidity against the specific natural vibration mode to be improved and the vibration of the specific natural vibration mode to be suppressed.

A part of the first rib portion may be integral with the side wall of the gear box. In addition, a part of the second rib portion may be integral with the side wall of the gear box. In addition, a part of the first rib portion, a part of the second rib portion, or a part of the central upper rib may be integral with the top plate of the gear box.

Since a part of the first rib portion and a part of the second rib portion are integral with the side wall of the gear box, the rigidity of the first rib portion and the second rib portion can be improved. In addition, integrating a part of the upper portion of the annular rib with the top plate of the gear box allows the rigidity of the upper portion of the annular rib to be improved, and the rigidity against the specific natural vibration mode to be improved. Therefore, both vibration of the specific natural vibration mode and torsion can be suppressed.

Preferably, the screw compressor further comprises a ninth rib portion connecting the first rib portion and a side wall of the gear box. Further, it is preferable that the screw compressor further comprise a tenth rib portion connecting the second rib portion and a side wall of the gear box.

Providing the ninth rib portion and the tenth rib portion allows the first rib portion and the second rib portion to be connected to the side wall of the gear box, and the rigidity of the first rib portion and the second rib portion to be improved. In addition, providing the eleventh rib portion allows at least one of the first rib portion, the second rib portion, and the third rib portion to be connected to the top plate of the gear box, and the rigidity of the annular rib to be improved. Therefore, both vibration of the specific natural vibration mode and torsion can be suppressed.

It is preferable that the height of the annular rib is larger than the average value of the plate thickness of the gear box.

Concretely specifying the height of the rib to not less than a certain value allows improvement in rigidity to be concretely achieved, and specifying the minimum value of the height of the rib allows the minimum rigidity to be secured.

According to the present invention, in a screw compressor, providing an annular rib around a first attachment hole and a second attachment hole of the gear box to improve the rigidity against the specific natural vibration mode allows the vibration to be efficiently reduced.

DESCRIPTION OF EMBODIMENTS

In the following, embodiments of the present invention will be described with reference to the accompanying drawings.

First Embodiment

Figure 1:
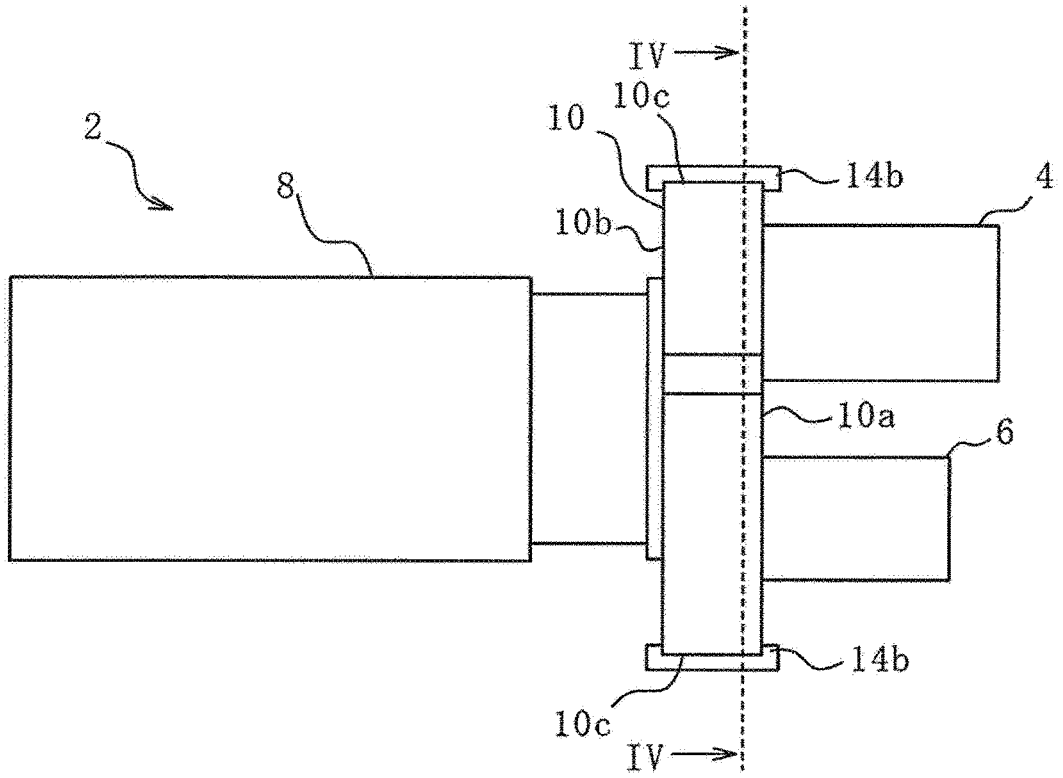
FIG. 1 is a plan view of a screw compressor according to a first embodiment of the present invention.
Figure 2:
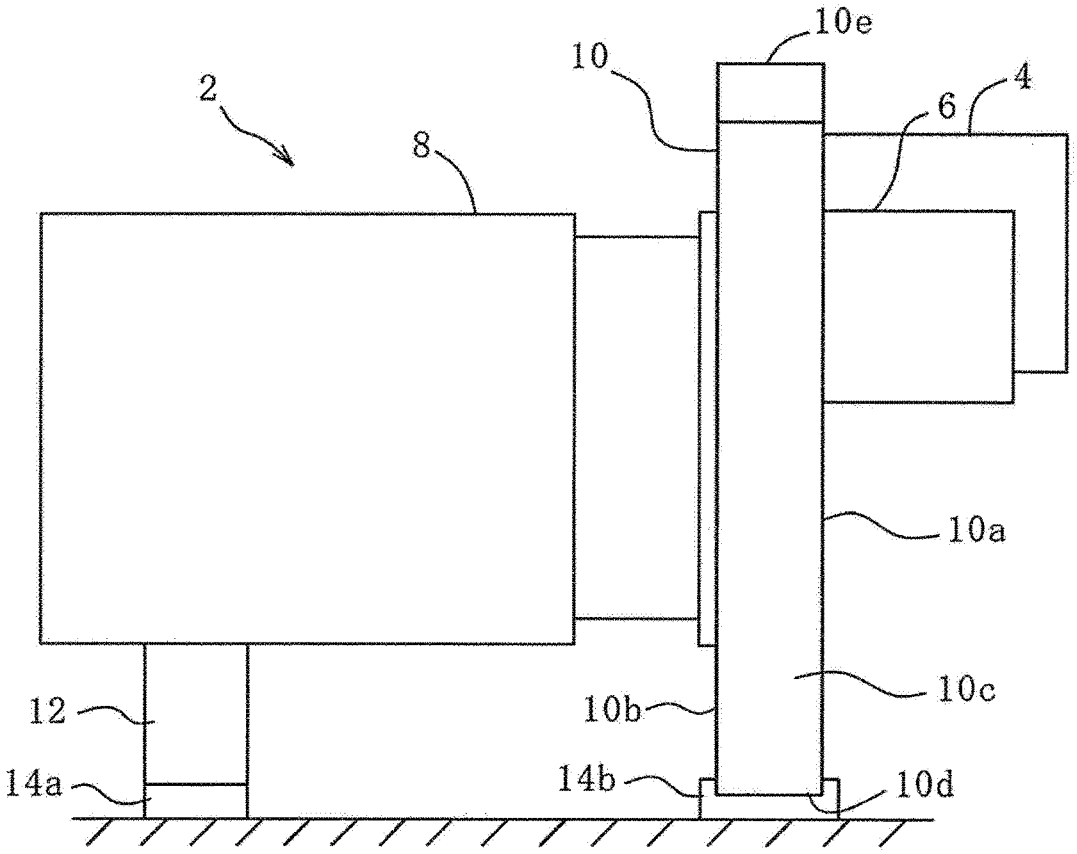
FIG. 2 is a side view of the screw compressor of FIG. 1.

Referring to FIGS. 1 and 2, a screw compressor 2 according to the present embodiment includes a first-stage compressor main body 4, a second-stage compressor main body 6, a motor (electric motor) 8, and a gear box 10.

The first-stage compressor main body 4 and the second-stage compressor main body 6 are attached to the gear box 10, and each of them includes inside a pair of male and female screw rotors (not shown). The screw rotors receive a driving force from the motor 8 via gears (not shown) arranged inside the gear box 10 to be driven. The discharge port of the first-stage compressor main body 4 and the intake port of the second-stage compressor main body 6 are fluidly connected with piping (not shown). The air is sucked and compressed by the first-stage compressor main body 4, supplied to the second-stage compressor main body 6, further compressed by the second-stage compressor main body 6, and then discharged.

The motor 8 is installed on the floor surface via a support member 12 and a rubber vibration insulator 14*a* in a state of being attached to the gear box 10. The motor 8 drives the first-stage compressor main body 4 and the second-stage compressor main body 6 as described above.

The gear box 10 is a box closed with a front wall 10*a*, a rear wall 10*b*, two side walls 10*c* and 10*c*, a bottom plate 10*d*, and a top plate 10*e*. The rear wall 10*b* is provided with a motor attachment hole (not shown) for attaching the motor 8. The front wall 10*a* is provided with a first attachment hole 10*f* for attaching the first-stage compressor main body 4 and a second attachment hole 10*g* for attaching the second-stage compressor main body 6 (see FIG. 4). The gear box 10 is installed on the floor surface with two rubber vibration insulators 14*b* attached under the bottom plate 10*d*.

Usually, when a driving force is transmitted from the motor 8 to the first-stage compressor main body 4 and the second-stage compressor main body 6 attached to the gear box 10, the first-stage compressor main body 4 and the second-stage compressor main body 6 vibrate with a plurality of natural vibration modes. Among the plurality of natural vibration modes, there is a mode particularly burdensome to the screw compressor 2. It is preferable to reduce the vibration of this burdensome mode for improving the durability.

Figure 3:
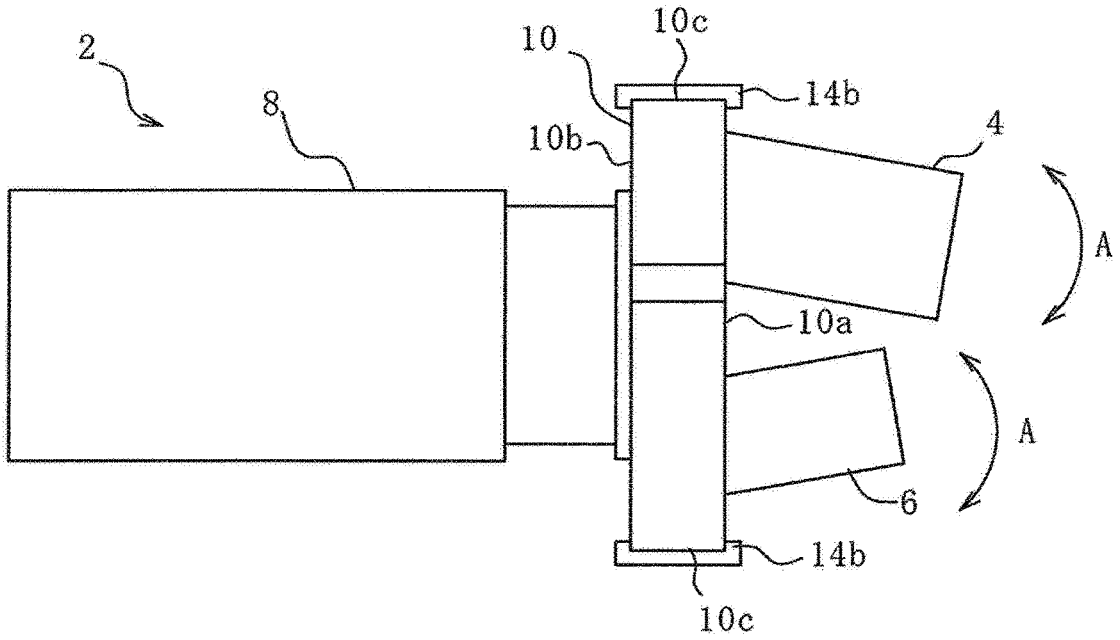
FIG. 3 is a schematic view showing a specific natural vibration mode of the screw compressor of FIG. 2.

As a result of various experiments and analyses, the inventor of the present invention specified a natural vibration mode in which the vibration is conspicuous among a plurality of natural vibration modes (hereinafter referred to as a "specific natural vibration mode"). Specifically, as shown in FIG. 3, the specific natural vibration mode is a vibration mode in the horizontal direction in which the first-stage compressor main body 4 and the second-stage compressor main body 6 repeat approaching and separating (see arrow A). The present invention is based on this new knowledge.

Figure 4:
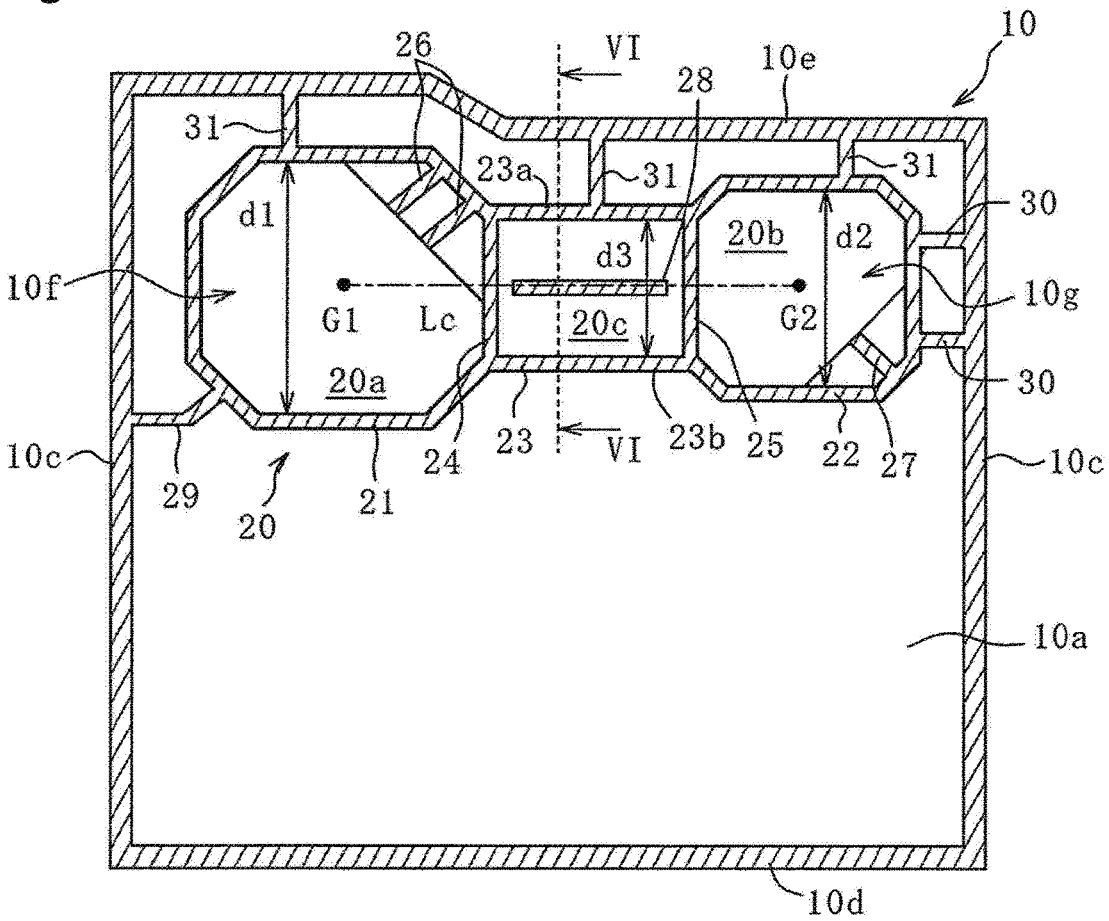
FIG. 4 is a sectional view of the screw compressor of FIG. 1 taken along a line IV-IV.

Referring to FIG. 4, in the screw compressor 2 according to the present embodiment, ribs are provided in efficient arrangements on the inner surface of the front wall 10*a* of the gear box 10 in order to suppress the vibration of the specific natural vibration mode (see FIG. 3). Hereinafter, the arrangement of the ribs will be described in detail.

On the inner surface of the front wall 10*a* of the gear box 10, an annular rib 20 surrounding the first attachment hole 10*f* and the second attachment hole 10*g* is provided around the first attachment hole 10*f* and the second attachment hole 10*g*. The width of the annular rib 20 is about the average value of the plate thickness of the front wall 10*a* and the height is somewhat larger than the average value of the plate thickness of the front wall 10*a*. The shape of the annular rib 20 is not particularly limited and only has to surround the first attachment hole 10*f* and the second attachment hole 10*g*, but it is preferable to form the annular rib 20 in the vicinity of the first attachment hole 10*f* and the second attachment hole 10*g*.

According to the above configuration, the vibration in the specific natural vibration mode can be efficiently reduced. Specifically, since the annular rib 20 is provided around the first attachment hole 10*f* and the second attachment hole 10*g* of the gear box 10 to improve the rigidity against the specific natural vibration mode, the screw compressor 2 can be reduced in vibration and can be made resistant to breakage. In addition, concretely specifying the height of the annular rib 20 to not less than a certain value allows improvement in rigidity to be concretely achieved, and specifying the minimum value of the height of the annular rib 20 (average value of the plate thickness of the front wall 10*a*) allows the minimum rigidity to be secured.

The annular rib 20 is divided into a first rib region 20*a*, a second rib region 20*b*, and a third rib region 20*c*. The first rib region 20*a* is a portion provided around the first attachment hole 10*f* and includes a first rib portion 21. The second rib region 20*b* is a portion provided around the second attachment hole 10*g* and includes a second rib portion 22. The third rib region 20*c* is a region between the first rib region 20*a* and the second rib region 20*b* and includes a third rib portion 23. Assume that the space in the portion widest in the vertical direction between the upper and lower portions of the first rib portion 21 is a first space d1, the space in the portion widest in the vertical direction between the upper and lower portions of the second rib portion 22 is a second space d2, and the space in the portion widest in the vertical direction between the upper and lower portions of the third rib portion 23 is a third space d3, then, in the present embodiment, the third space d3 is not more than the first space d1 and not more than the second space d2. That is, the third space d3 is the narrowest, and the annular rib 20 has a shape in which the central portion is narrowed.

In addition, an imaginary center line Lc connecting a center G1 of the first attachment hole 10*f* and a center G2 of the second attachment hole 10*g* is set. In this case, a central upper rib 23*a* being the rib on the upper side of the third rib portion 23 is arranged above the imaginary center line Lc, and a central lower rib 23*b* being the rib on the lower side of the third rib portion 23 is arranged below the imaginary center line Lc. That is, the imaginary center line Lc is arranged between the central upper rib 23*a* and the central lower rib 23*b*. In the present embodiment, the central upper rib 23*a* and the central lower rib 23*b* are formed in parallel.

The third space d3 is narrower than the other spaces d1 and d2, so that the rigidity against the specific natural vibration mode of the third rib portion 23 can be improved, and vibration in the specific natural vibration mode can be suppressed. This is because a comparison of when the third space d3 is wide and when the third space d3 is narrow shows that the rigidity against the specific natural vibration mode improves when the third space d3 is narrow. In addition, since the central upper rib 23*a* is arranged above the imaginary center line Lc and the central lower rib 23*b* is arranged below the imaginary center line Lc, the rib arrangement in the vertical direction can be balanced, and the torsion in the front wall 10*a* of the gear box 10 can be suppressed.

Figure 6:
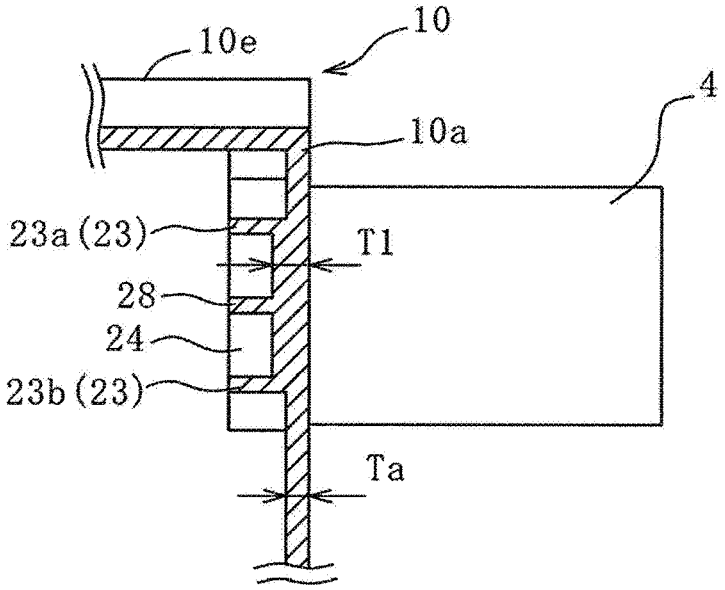
FIG. 6 is a sectional view of sectional view of the screw compressor of FIG. 4 taken along a line VI-VI.

Referring to FIG. 6, a plate thickness T1 of the front wall 10*a* of the gear box 10 between the central upper rib 23*a* and the central lower rib 23*b* is formed to be thicker than an average value Ta of the plate thickness of the other portions of the gear box 10. In order to increase the plate thickness T1 of the portion of the front wall 10*a*, the portion may be patched with a different plate-shaped member. In the present embodiment, the plate thickness T1 of the portion of the front wall 10*a* is formed about 1.2 to 2.0 times thicker than the average value Ta of the plate thickness of the other portions, but the numerical value is not limited.

Since the portion of the front wall 10*a* of the gear box 10 between the central upper rib 23*a* and the central lower rib 23*b* has an amount of deformation larger than the other portions of the front wall 10*a* of the gear box 10 in the vibration of the specific natural vibration mode, increasing the plate thickness of this portion allows the rigidity against the specific natural vibration mode to be improved and the vibration of the specific natural vibration mode to be suppressed.

As shown together in FIGS. 4 and 6, the inner surface of the front wall 10*a* of the gear box 10 is provided with a fourth rib portion 24 connecting the connection portion of the first rib portion 21 and the central upper rib 23*a*, and the connection portion of the first rib portion 21 and the central lower rib 23*b*. In addition, the inner surface of the front wall 10*a* of the gear box 10 is provided with a fifth rib portion 25 connecting the connection portion of the second rib portion 22 and the central upper rib 23*a*, and the connection portion of the second rib portion 22 and the central lower rib 23*b*.

Providing the fourth rib portion 24 and the fifth rib portion 25 causes the rigidity around the first attachment hole 10*f* and the second attachment hole 10*g* to be improved and the rigidity against the specific natural vibration mode to be improved, and allows the rigidity against torsion in the front wall 10*a* to be also improved. Therefore, both vibration of the specific natural vibration mode and torsion can be suppressed.

In addition, the inner surface of the front wall 10*a* of the gear box 10 is provided with a sixth rib portion 26 connecting the outer periphery of the first attachment hole 10*f* and the first rib portion 21. Furthermore, the inner surface of the front wall 10*a* of the gear box 10 is provided with a seventh rib portion 27 connecting the outer periphery of the second attachment hole 10*g* and the second rib portion 22. In the present embodiment, two sixth rib portions 26 are provided and one seventh rib portion 27 is provided, but the number thereof is not particularly limited. In addition, the sixth rib portion 26 may connect the outer periphery of the first attachment hole 10*f* and the fourth rib portion 24, and the seventh rib portion 27 may connect the outer periphery of the second attachment hole 10*g* and the fifth rib portion 25.

Providing the sixth rib portion 26 and the seventh rib portion 27 allows the rigidity around the first attachment hole 10*f* and the second attachment hole 10*g* and the rigidity against torsion in the front wall 10*a* to be improved. Therefore, both vibration of the specific natural vibration mode and torsion can be suppressed.

Figure 5:
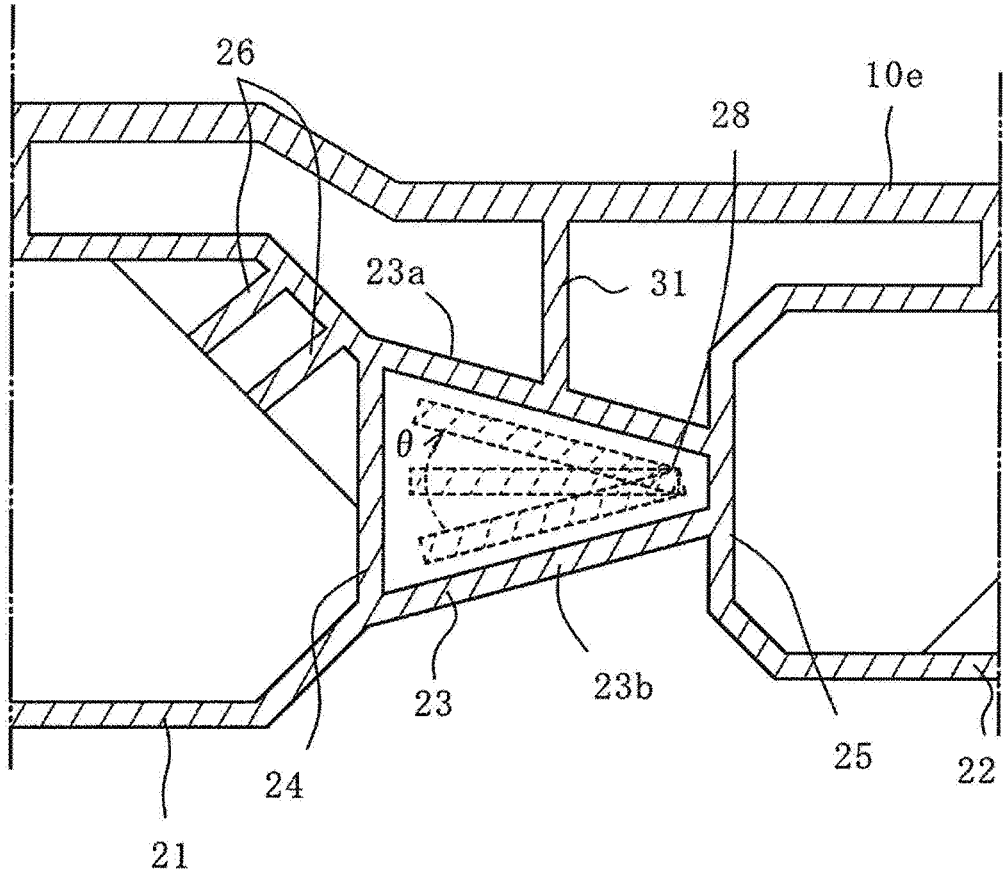
FIG. 5 is a sectional view of a modified example of the eighth rib portion shown in FIG. 4.

In addition, the inner surface of the front wall 10*a* of the gear box 10 is provided with an eighth rib portion 28 extending along the central upper rib 23*a* and the central lower rib 23*b* between the central upper rib 23*a* and the central lower rib 23*b*. In the present embodiment, since the central upper rib 23*a* and the central lower rib 23*b* are formed in parallel, the eighth rib portion 28 extends along both of them. However, as shown in FIG. 5, when the central upper rib 23*a* and the central lower rib 23*b* are not formed in parallel, the eighth rib portion 28 only has to extend along at least one of the central upper rib 23*a* and the central lower rib 23*b* as indicated by broken lines. Alternatively, the eighth rib portion 28 may extend at an angle within an angle θ formed between the central upper rib 23*a* and the central lower rib 23*b* with respect to the central lower rib 23*b*.

Providing the eighth rib portion 28 allows the rigidity against the specific natural vibration mode to be improved and the vibration of the specific natural vibration mode to be suppressed.

In addition, the inner surface of the front wall 10*a* of the gear box 10 is provided with a ninth rib portion 29 connecting the first rib portion 21 and the side wall 10*c* of the gear box 10. Furthermore, the gear box 10 is provided with a tenth rib portion 30 connecting the second rib portion 22 and the side wall 10*c* of the gear box 10. In the present embodiment, one ninth rib portion 29 is provided and two tenth rib portions 30 are provided, but the number thereof is not particularly limited. In addition, in order to shorten the length of the rib, it is preferable that the ninth rib portion 29 connects the left side portion of the first rib portion 21 and the side wall 10*c* of the gear box 10 in FIG. 4. Similarly, it is preferable that the tenth rib portion 30 connects the right side portion of the second rib portion 22 and the side wall 10*c* of the gear box 10 in FIG. 4.

In addition, the gear box 10 is provided with respective three eleventh rib portions 31 connecting the first rib portion 21, the second rib portion 22, and the central upper rib 23*a* with the top plate 10*e* of the gear box 10. In the present embodiment, three eleventh rib portions 31 are provided, but the number thereof is not limited, and at least one of the first rib portion 21, the second rib portion 22, and the central upper rib 23*a* only has to be connected with the top plate 10*e* of the gear box 10.

Providing the ninth rib portion 29 and the tenth rib portion 30 allows the first rib portion 21 and the second rib portion 22 to be connected to the side wall 10*c* of the gear box 10, and the rigidity of the first rib portion 21 and the second rib portion 22 to be improved. In addition, providing the eleventh rib portion 31 allows at least one of the first rib portion 21, the second rib portion 22, and the third rib portion 23 to be connected to the top plate 10*e* of the gear box 10, and the rigidity of the annular rib 20 to be improved. Therefore, both vibration of the specific natural vibration mode and torsion can be suppressed.

Second Embodiment

Figure 7:
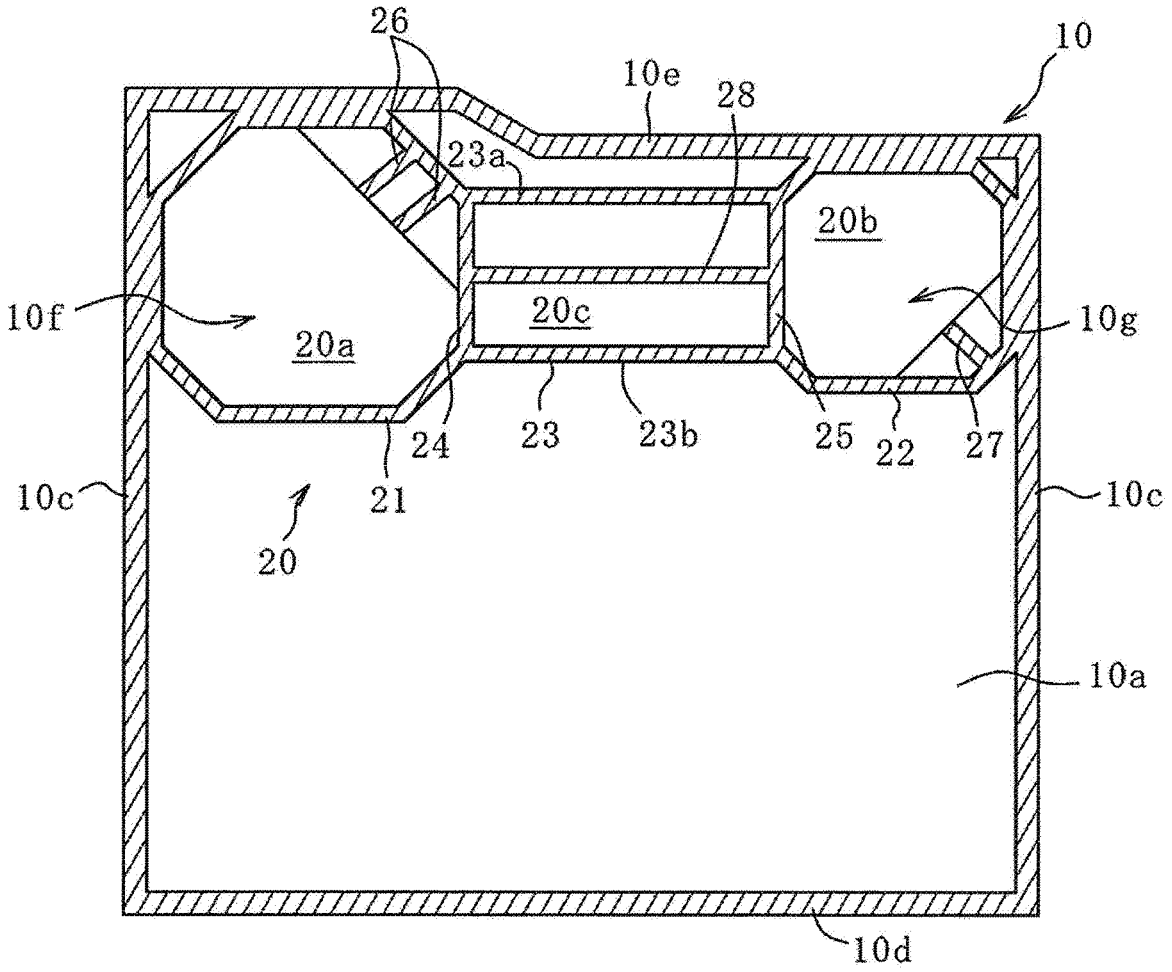
FIG. 7 is a sectional view of a screw compressor according to a second embodiment of the present invention.

In the screw compressor 2 of the second embodiment shown in FIG. 7, a part of the first rib portion 21 and a part of the second rib portion 22 are integral with the top plate 10*e* and the side wall 10*c* of the gear box 10. The present embodiment is substantially the same as the first embodiment in FIG. 4 except for this point. Therefore, description of parts similar to the configuration shown in FIGS. 1 to 6 will be omitted.

In the present embodiment, the ninth to eleventh rib portions 29 to 31 (see FIG. 4) of the first embodiment are omitted, and a part of the first rib portion 21 and a part of the second rib portion 22 are integral with the top plate 10*e* and the side wall 10*c* of the gear box 10. As a modification of the present embodiment, a part of the third rib portion 23 may be integral with the top plate 10*e* of the gear box 10.

Since a part of the first rib portion 21 and a part of the second rib portion 22 are integral with the side wall 10*c* of the gear box 10, the rigidity of the first rib portion 21 and the second rib portion 22 can be improved. In addition, integrating a part of the upper portion of the annular rib 20 with the top plate 10*e* of the gear box 10 allows the rigidity of the upper portion of the annular rib 20 to be improved, and the rigidity against the specific natural vibration mode to be improved. Therefore, both vibration of the specific natural vibration mode and torsion can be suppressed.

The invention claimed is:

1. A screw compressor comprising:

a first-stage compressor main body and a second-stage compressor main body respectively configured to compress fluid with screw rotors;

an electric motor configured to drive the first-stage compressor main body and the second-stage compressor main body; and a gear box connected to the first-stage compressor main body, the second-stage compressor main body, and the electric motor, and configured to transmit a driving force of the electric motor to the screw rotors of the first-stage and second-stage compressor bodies, the gear box including a first attachment hole for attaching the first-stage compressor main body and a second attachment hole for attaching the second-stage compressor main body, and being provided with an annular rib surrounding an entire contour of the first attachment hole and an entire contour of the second attachment hole, wherein the annular rib includes:

a first rib region being a portion provided around the first attachment hole, a second rib region being a portion provided around the second attachment hole, and a third rib region being a region between the first rib region and the second rib region, wherein a maximum space in a vertical direction between an upper portion and a lower portion of a first rib portion constituting the first rib region is a first space, wherein a maximum space in a vertical direction between an upper portion and a lower portion of a second rib portion constituting the second rib region is a second space, wherein a maximum space in a vertical direction between an upper portion and a lower portion of a third rib portion constituting the third rib region is a third space, wherein the third space is not more than the first space and not more than the second space, wherein a central upper rib being a rib on an upper side of the third rib portion is arranged above an imaginary center line connecting a center of the first attachment hole and a center of the second attachment hole, and wherein a central lower rib being a rib on a lower side of the third rib portion is arranged below the imaginary center line, and wherein the screw compressor further comprises, between the central upper rib and the central lower rib, an additional rib portion extending along the central upper rib or the central lower rib, or extending along the central lower rib within a range of an angle formed between the central upper rib and the central lower rib.

2. The screw compressor according to claim 1, wherein a plate thickness of the gear box between the central upper rib and the central lower rib is larger than an average value of plate thicknesses of other portions of the gear box.

3. The screw compressor according to claim 1, wherein a part of the first rib portion is integral with a side wall of the gear box.

4. The screw compressor according to claim 1, further comprising an additional rib portion connecting the first rib portion and a side wall of the gear box.

5. The screw compressor according to claim 1, wherein a part of the second rib portion is integral with a side wall of the gear box.

6. The screw compressor according to claim 1, further comprising an additional rib portion connecting the second rib portion and a side wall of the gear box.

7. The screw compressor according to claim 1, wherein a part of the first rib portion, a part of the second rib portion, or a part of the central upper rib is integral with a top plate of the gear box.

8. The screw compressor according to claim 1, further comprising an additional rib portion connecting the first rib portion, the second rib portion, or the central upper rib and a top plate of the gear box.

9. The screw compressor according to claim 1, wherein a height of the annular rib is larger than an average value of a plate thickness of the gear box.

10. A screw compressor comprising:

a first-stage compressor main body and a second-stage compressor main body respectively configured to compress fluid with screw rotors;

an electric motor configured to drive the first-stage compressor main body and the second-stage compressor main body; and a gear box connected to the first-stage compressor main body, the second-stage compressor main body, and the electric motor, and configured to transmit a driving force of the electric motor to the screw rotors of the first-stage and second-stage compressor bodies, the gear box including a first attachment hole for attaching the first-stage compressor main body and a second attachment hole for attaching the second-stage compressor main body, and being provided with an annular rib surrounding an entire contour of the first attachment hole and an entire contour of the second attachment hole, wherein the annular rib includes:

a first rib region being a portion provided around the first attachment hole, a second rib region being a portion provided around the second attachment hole, and a third rib region being a region between the first rib region and the second rib region, wherein a maximum space in a vertical direction between an upper portion and a lower portion of a first rib portion constituting the first rib region is a first space, wherein a maximum space in a vertical direction between an upper portion and a lower portion of a second rib portion constituting the second rib region is a second space, wherein a maximum space in a vertical direction between an upper portion and a lower portion of a third rib portion constituting the third rib region is a third space, wherein the third space is not more than the first space and not more than the second space, wherein a central upper rib being a rib on an upper side of the third rib portion is arranged above an imaginary center line connecting a center of the first attachment hole and a center of the second attachment hole, and wherein a central lower rib being a rib on a lower side of the third rib portion is arranged below the imaginary center line, and wherein the screw compressor further comprises:

a fourth rib portion connecting a connection portion between the first rib portion and the central upper rib and a connection portion between the first rib portion and the central lower rib, a fifth rib portion connecting a connection portion between the second rib portion and the central upper rib and a connection portion between the second rib portion and the central lower rib, and a sixth rib portion connecting an outer periphery of the first attachment hole and the first rib portion or the fourth rib portion.

11. The screw compressor comprising:

a first-stage compressor main body and a second-stage compressor main body respectively configured to compress fluid with screw rotors;

an electric motor configured to drive the first-stage compressor main body and the second-stage compressor main body; and a gear box connected to the first-stage compressor main body, the second-stage compressor main body, and the electric motor, and configured to transmit a driving force of the electric motor to the screw rotors of the first-stage and second-stage compressor bodies, the gear box including a first attachment hole for attaching the first-stage compressor main body and a second attachment hole for attaching the second-stage compressor main body, and being provided with an annular rib surrounding an entire contour of the first attachment hole and an entire contour of the second attachment hole, wherein the annular rib includes:

a first rib region being a portion provided around the first attachment hole, a second rib region being a portion provided around the second attachment hole, and a third rib region being a region between the first rib region and the second rib region, wherein a maximum space in a vertical direction between an upper portion and a lower portion of a first rib portion constituting the first rib region is a first space, wherein a maximum space in a vertical direction between an upper portion and a lower portion of a second rib portion constituting the second rib region is a second space, wherein a maximum space in a vertical direction between an upper portion and a lower portion of a third rib portion constituting the third rib region is a third space, wherein the third space is not more than the first space and not more than the second space, wherein a central upper rib being a rib on an upper side of the third rib portion is arranged above an imaginary center line connecting a center of the first attachment hole and a center of the second attachment hole, and wherein a central lower rib being a rib on a lower side of the third rib portion is arranged below the imaginary center line, and wherein the screw compressor further comprises:

a fourth rib portion connecting a connection portion between the first rib portion and the central upper rib and a connection portion between the first rib portion and the central lower rib, a fifth rib portion connecting a connection portion between the second rib portion and the central upper rib and a connection portion between the second rib portion and the central lower rib, and an additional rib portion connecting an outer periphery of the second attachment hole and the second rib portion or the fifth rib portion.

* * * * *